US008387834B2

(12) United States Patent
Proper et al.

(10) Patent No.: US 8,387,834 B2
(45) Date of Patent: Mar. 5, 2013

(54) DISPENSER WITH COLLAPSIBLE DISPENSING TUBE

(75) Inventors: Scott T. Proper, Stow, OH (US); Brent Huxtable, Clinton, OH (US)

(73) Assignee: GOJO Industries, Inc., Akron, OH (US)

( * ) Notice: Subject to any disclaimer, the term of this patent is extended or adjusted under 35 U.S.C. 154(b) by 496 days.

(21) Appl. No.: 12/556,966

(22) Filed: Sep. 10, 2009

(65) Prior Publication Data

US 2011/0056990 A1 Mar. 10, 2011

(51) Int. Cl.
*G01F 11/00* (2006.01)

(52) U.S. Cl. ..... 222/321.8; 222/181.3; 222/183; 222/207; 222/321.7; 222/321.9; 222/383.3; 222/571

(58) Field of Classification Search .... 222/181.1–181.3, 222/183, 105, 190, 207, 209, 321.7, 212, 222/321.8, 321.9, 571, 383.1, 385, 383.3, 222/633

See application file for complete search history.

(56) References Cited

U.S. PATENT DOCUMENTS 4,448,329 A 5/1984 Vilaseca
4,715,517 A 12/1987 Potter
4,978,036 A * 12/1990 Burd ..... 222/207
5,725,131 A * 3/1998 Bell et al. ..... 222/196
6,053,370 A * 4/2000 Ludbrook et al. ..... 222/207
6,089,410 A * 7/2000 Ponton ..... 222/183
6,273,297 B1 8/2001 Schalow
6,543,653 B2 * 4/2003 Lamboux ..... 222/321.8
6,598,765 B2 * 7/2003 Pagel et al. ..... 222/214
7,874,463 B2 * 1/2011 Ciavarella ..... 222/321.8
2007/0157991 A1 * 7/2007 Robertson ..... 141/360
2009/0184134 A1 * 7/2009 Ciavarella et al. ..... 222/135

* cited by examiner

*Primary Examiner* — Frederick C. Nicolas
(74) *Attorney, Agent, or Firm* — Calfee, Halter & Griwold LLP

(57) ABSTRACT

A dispenser includes a housing and a push bar movable between a rest position and an actuated position. A container is retained in the housing and holds a liquid, and a pump is associated with a liquid. The pump is actuated to dispense a dose of the liquid, when the push bar is moved from its rest position to its actuated position. A dispensing tube includes an inlet associated with the pump, an outlet associated with the push bar, and a bellows portion between the inlet and the outlet. Upon moving the push bar from its rest position to its actuated position, the bellows portion is collapsed from an expanded volume to a compressed volume, and the outlet of the dispensing tube moves with the push bar. Upon return of the push bar from the actuated position to the rest position, the bellows portion expands from the compressed volume to the expanded volume, and draws liquid at the tip of the dispensing tube into the dispensing tube to reduce or eliminate dripping. Pinch members are employed to pinch the dispensing tube closed to prevent product dripping therefrom when the dispenser is not in use.

20 Claims, 4 Drawing Sheets

DISPENSER WITH COLLAPSIBLE DISPENSING TUBE

TECHNICAL FIELD

The invention herein resides in the art of liquid dispensers. More particularly, the invention relates to a dispenser having a push bar that is pushed to dispense fluid to a user's hand.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply emitting a predetermined quantity of the liquid upon movement of an actuator. Recently, for purposes of effectiveness and economy, it has become desirable is to dispense the liquids in the form of foam, generated by the interjection of air into the liquid. Accordingly, the standard liquid pump has given way to a foam generating pump, which necessarily requires means for combining the air and liquid in such a manner as to generate the desired foam. The concepts taught herein are applicable to both liquid and foam dispensers.

Of particular interest are those dispensers providing a push bar that is pushed from a rest position to an actuated position to actuate the pump mechanism and dispense foam to the operator's hand. Typically the dispensing tube extending from the pump mechanism is stationary and provides an outlet that is distanced from the push bar in its rest position. To dispense liquid, the operator cups his fingers under the outlet of the dispensing tube while pushing the push bar toward the outlet with the base of his palm. This dispenses the liquid through the outlet and onto his hand. This general structure presents some problems for those with small hands, as they may not be large enough to both engage the push bar and register with the outlet. For individuals with small hands, an initial dose of liquid may miss their hand and be dispensed to the floor or their clothing, that is, until their hand aligns under the outlet. For all individuals operating such dispensers, the dose of liquid is dispensed in a line across their hand because their hand moves relative to the outlet as the push bar is moved. In order to place the dose of liquid in a more consistent location on the operator's hand, some dispensers are structured such that the dispensing tube outlet is associated with the push bar to move with the push bar. Examples of such dispensers can be seen in U.S. Pat. Nos. 5,556,005, 5,797,517, 5,992,698, 6,648,179, and 7,198,177. The present invention improves on the general concept of associating the dispensing tube outlet to move with the push bar.

It is well-known in the dispenser arts, particularly in soap and sanitizer dispensers that the dispensers sometimes drip product. When product is dispensed there is typically a continuous stream of product retained a dispensing path, for example, from an outlet valve of the pump to the actual outlet where the product exits the dispenser to fall on an individual's hand. This residual product can drip out of the dispenser and onto the floor under the effect of gravity. This is particularly true for a dispensed foam product, even more particularly a foamed soap or foamed sanitizer, because the multitude of air bubbles within the foam begin to collect, forming larger air bubbles such that the liquid portion of the foam also collects together to form a more readily flowing liquid that can drip out of the dispenser. Thus, there is a need in the art to take measures to ensure that residual product within a dispenser is prevented from dripping out of the dispenser, and particular embodiments of this invention provides structures to achieve such an anti-drip function.

SUMMARY OF THE INVENTION

This invention, in at least one embodiment thereof, provides a dispenser that includes a housing and a push bar, which is movable between a rest position and an actuated position. A container is retained in the housing and holds a liquid. A pump is associated with the liquid in the container, and is actuated to dispense a dose of the liquid when the push bar is moved from its rest position to its actuated position. A dispensing tube includes an inlet associated with the pump, an outlet, and a bellows portion between the inlet and the outlet. The dispensing tube is secured to the push bar proximate the outlet of the dispensing tube such that, upon moving the push bar from its rest position to its actuated position, the outlet moves as well. The dispenser further includes a first pinch member that is associated with the housing and a second pinch member that is associated with the push bar. When the push bar is in the rest position, the dispensing a portion of the dispensing tube is pinched between the first pinch member and the second pinch member such that product cannot drip from the dispensing tube.

DETAILED DESCRIPTION OF THE INVENTION

Figure 2:
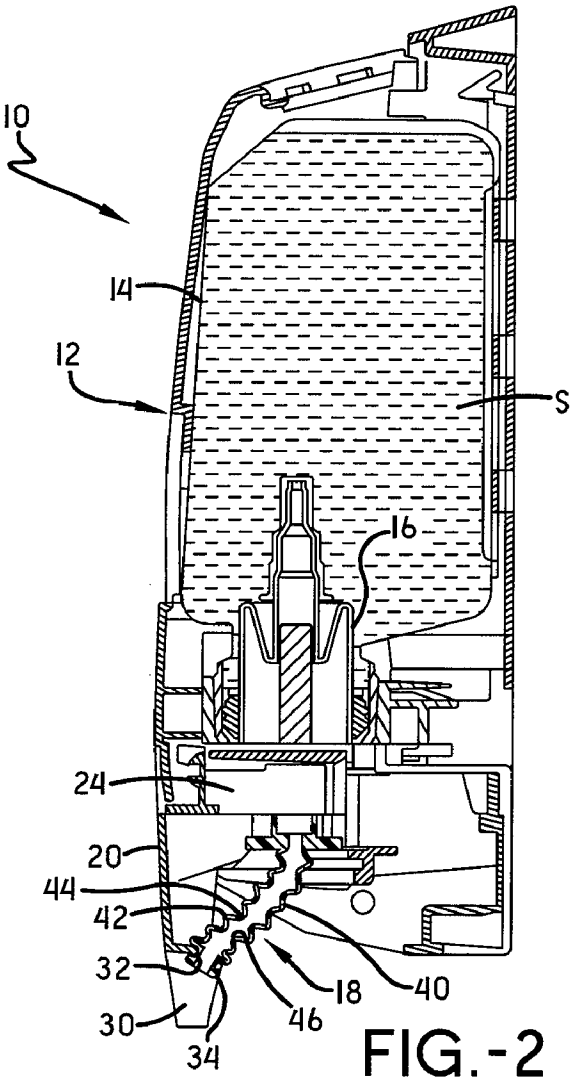
FIG. 2 is a stepped cross sectional view of the dispenser of FIG. 1, taken along the line 2-2.
Figure 1:
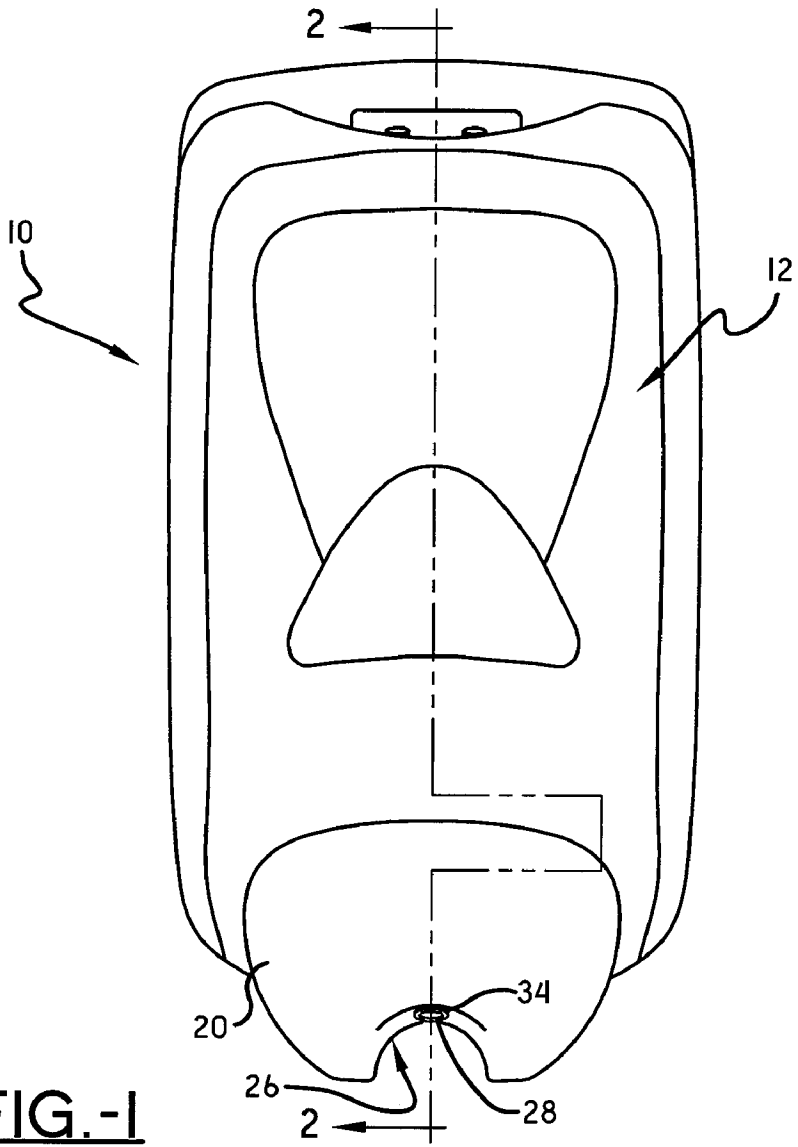
FIG. 1 is a front elevational view of the dispenser of this invention.
Figure 3:
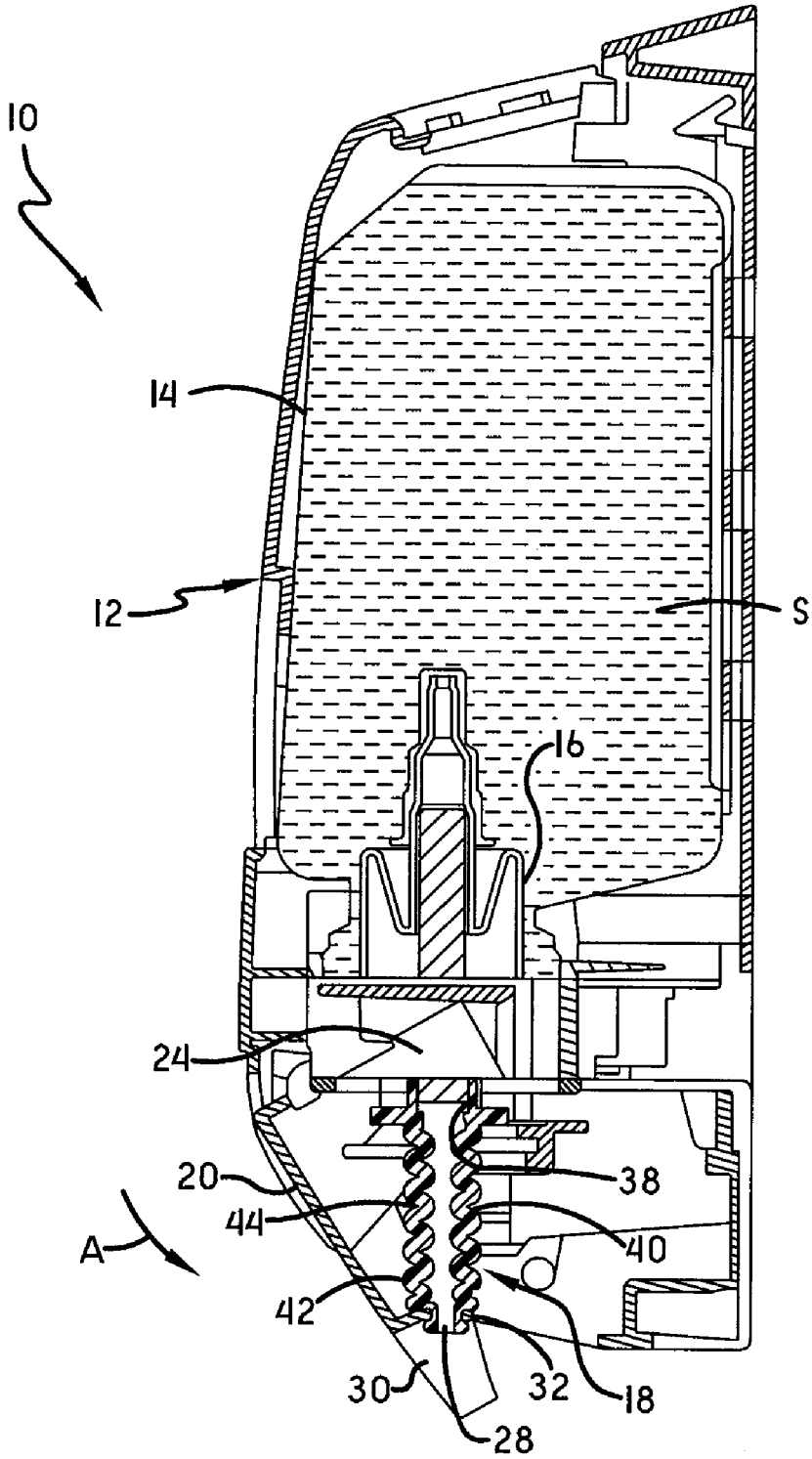
FIG. 3 is a stepped cross sectional similar to that in FIG. 2, but shown at an actuated position wherein the pump has been actuated by the fins of the push bar.

With reference to FIGS. 1-3, a dispenser in accordance with this invention is shown and designated by the numeral 10. The dispenser 10 includes a housing 12 that receives a container 14 holding liquid S for dispensing. A pump 16 is associated with the liquid S in the container 14, and is actuated to dispense a dose of the liquid S through a dispensing tube 18 associated with the pump 16. The pump 16 is actuated by movement of a push bar 20, which is typically associated with the housing 12, though this invention is not limited to or by that particular structure.

Figure 4:
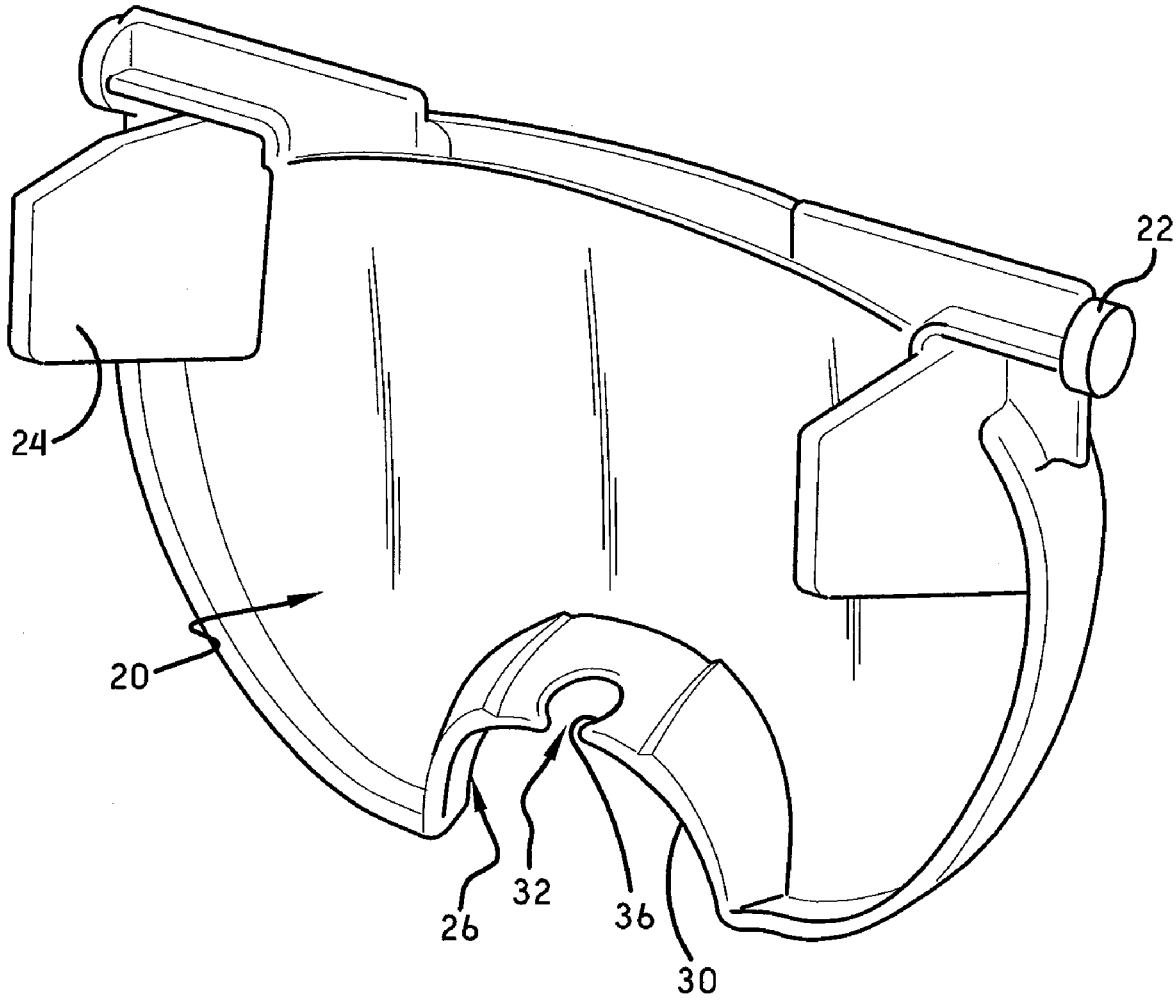
FIG. 4 is a perspective view showing the structure of an embodiment of a push bar in accordance with this invention.

In this embodiment, the pump 16 is a reciprocating piston pump for dispensing either the liquid S alone or a mixture of the liquid S and air to create foam. Such piston pumps are well known, and the present invention is not limited to such a particular pump, it being sufficient for purposes of this invention that the pump be of a type that is actuated by movement of a push bar. For example, a dome pump or bellows pump wherein a collapsible dome or bellows is compressed by movement of a push bar to dispense liquid would also be suitable. Thus, the push bar 20 is pivotally secured to the housing 12, as at hinge 22 (FIG. 4), to be movable between a rest position, as seen in FIG. 2, and an actuated position, as seen in FIG. 3. In the rest position, the pump 16 is not acted upon, and it too remains at rest. However, as the push bar 20 is moved to the actuated position, the pump 16 is acted upon and moved to an actuated position to pump either the liquid S or the liquid S and air (when the pump 16 is a foam pump). In the embodiment shown, one or more fins 24 extend from the push bar 20 to engage the pump 16 or an auxiliary structure that engages the pump 16, and these fins 24 pivot with the push bar 20, such that they actuate the pump 16 (either directly or through the auxiliary structure) as push bar 20 is moved in the direction of arrow A, from the rest position of FIG. 2, to the actuated position of FIG. 3.

It will be appreciated that various types of push bar actuated dispensers are known in the art, this invention is not limited to any particular pump or push bar structure necessary to actuate that pump. The embodiment in the figures shows a reciprocating pump, though it is represented very symbolically in light of it being well known. However, the inventive concepts herein respecting a dispensing tube are readily applicable to different push bar actuated dispensers, for example, those employing what are now known as dome pumps, wherein a flexible dome defining a dose volume is collapsed to the dispense fluid and is expanded to draw in a dose of fluid. Thus, it should be appreciated that the scope of this invention potentially covers any push bar actuated dispenser.

As seen in FIGS. 1-4, the push bar 20 includes a dispensing tube adaptor 26 that is provided to selectively receive the dispensing tube 18 associated with the pump 16. The dispensing tube adaptor 26 is used to secure the dispensing tube 18 to the push bar 20 such that the outlet 28 of the dispensing tube 18 moves with the push bar 20. In this embodiment, a concave wall 30 in the push bar 20 extends in the direction of movement of the push bar 20 and provides a mount 32 for the distal end 34 of the dispensing tube 18. This mount 32 can be any suitable selective securing structure, though it is shown here as a notch 36 that receives the distal end 34 through a friction fit. In this embodiment, the dispensing tube 18 is made from a resilient material that is forced into place at mount 32 to be held thereby. This is especially advantageous when the dispensing tube 18 is provided as part of a refill unit made up of the container, the pump, auxiliary structures (if employed), and the dispensing tube, because the dispensing tube is easily mounted to the push bar once the refill unit is mounted in the housing.

The dispensing tube 18 extends from an inlet 38 associated with the pump 16 to an outlet 28 associated with the push bar 20. Between the inlet 38 and the outlet 28, the dispensing tube 18 includes a bellows portion 40. In the embodiment shown, the entire dispensing tube 18 is formed of a bellows portion 40, but it should be appreciated that the inventive concepts herein would still be achieved by providing only a portion of the length of dispensing tube 18 as a bellows portion 40. Preferably, if only a portion of the dispensing tube 18 is to be formed as a bellows, the bellows portion would be closer to outlet 28. This places the ridges and valleys of the bellows portion 40 close to the outlet 28 such that they provide channels for holding liquid or foam sucked back into the dispensing tube. As seen in comparison of FIG. 2 and FIG. 3, upon moving the push bar 20 from the rest position to the actuated position, the bellows portion 40 is collapsed from an expanded volume (FIG. 2) to a compressed volume (FIG. 3) and the outlet 28 moves with the push bar 20. The dose of liquid dispensed is therefore dropped onto a consistent location on the operator's hand.

The push bar 20 is biased to its rest position by either the reciprocating mechanisms of the pump 16 or by a separate biasing mechanism. This is generally known in the art. Upon release of the push bar 20, it returns to its rest position, and this causes the bellows portion 40 of the dispensing tube 18 to expand to its expanded volume. As the bellows portion 40 expands, a vacuum is created, and liquid (or foam in the case of a foam pump) proximate the outlet 28 is sucked further back into the dispensing tube 18, thus minimizing or eliminating the potential for liquid to drip from the outlet 28.

In this embodiment, the bellows portion 40 is corrugated, as at ridges 42 and valleys 44, and is made of a material that provides the bellows portion 40 with the ability to reversibly collapse and extend between the compressed volume and the expanded volume shown. These ridges 42 and valleys 44 are advantageous in that they provide channels 46 for holding liquid away from outlet 28 to prevent dripping. They also collapse toward one another to decrease the volume of the bellows portion 40 as the dispenser 10 is actuated. More particularly, the distance between the inlet 38 and the distal end 34 of the dispensing tube 18 is greater in the unactuated, rest position than in the actuated position, and, as a result, at least a portion of the corrugated length of the dispensing tube 18 collapses onto itself as the push bar 20 is moved from the rest position to the actuated position. Similarly, as the push bar 20 moves from the actuated position to the rest position these collapsed portions expand.

Figure 6:
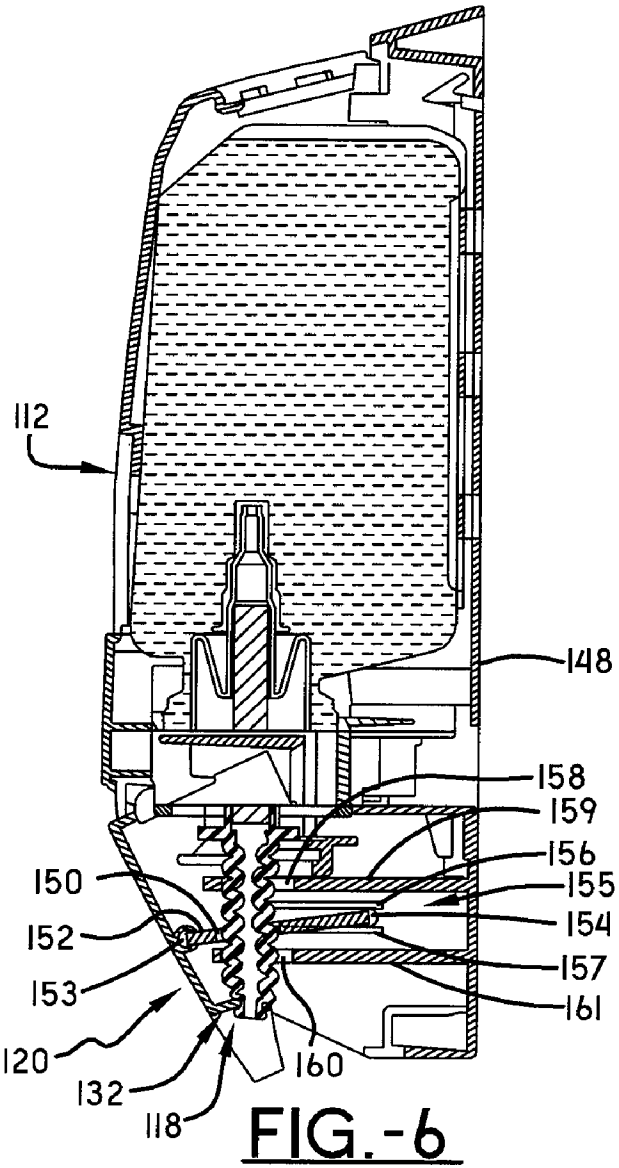
FIG. 6 is a stepped cross sectional view similar to that in FIG. 5, showing the dispenser in an actuated position, similar to that as in FIG. 3, but shown with the anti-drip features of FIG. 5.
Figure 5:
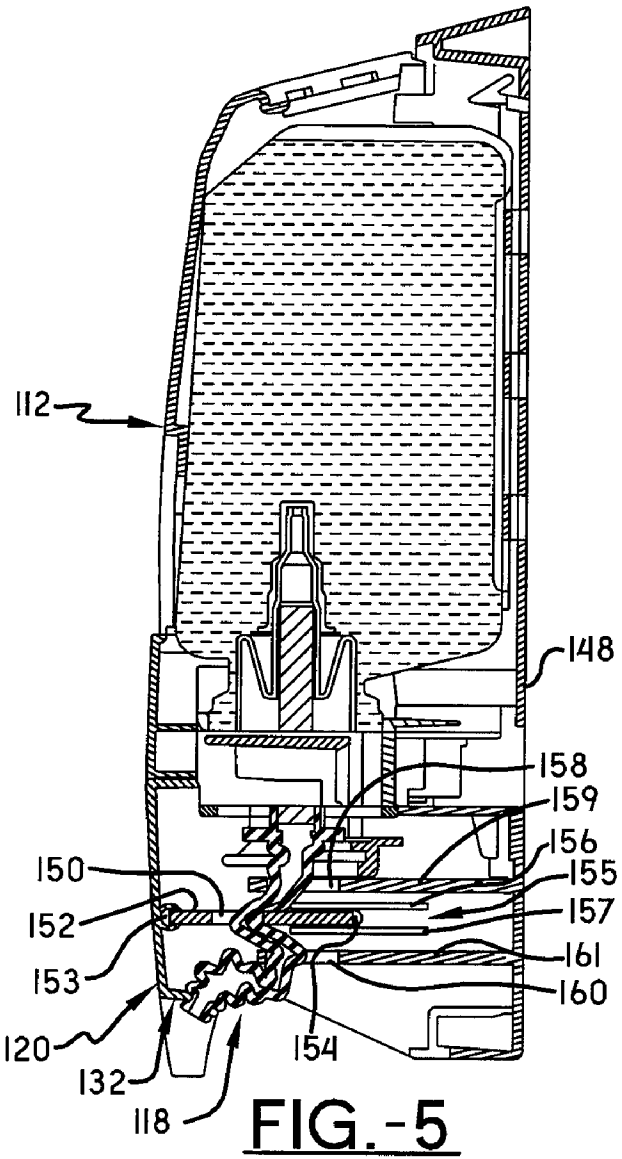
FIG. 5 is a stepped cross sectional view similar to that in FIG. 2, taken along the line 2-2 of FIG. 1, but showing an alternative embodiment of the invention wherein structures are provided to pinch the dispensing tube to prevent dripping.

In another embodiment in accordance with this invention and shown in FIGS. 5 and 6, structures are provided to pinch the dispensing tube and prevent product from dripping out of the dispensing tube when the dispenser is in the rest position. The rest position is shown in FIG. 5, while an actuated position is shown in FIG. 6. When describing elements that are similar to elements in the embodiment of FIGS. 1-4, like parts have received like numerals though increased by 100. In this embodiment, the dispensing tube 118 extends through an aperture 150 in a push bar plate 152 extending from a pivotal connection 153 to the push bar 120 to a pivotal connection 154 to a track 155 having opposed track rails 156 and 157, which are integral with or otherwise securely associated with the housing 112. In the cross section shown, only the portion of the track 155 that extends from a far wall of the housing is shown, because the near wall is not present in the cross section. It will be appreciated that a similar rail system complimenting rails 156 and 157 extends from the near wall to complet the track 155. The push bar plate 152 fits between these sets of rails so as to move vertically therebetween, as can be seen in comparison of FIGS. 5 and 6.

The push bar plate 152 and aperture 150 serve as a first pinch member for pinching the dispensing tube 118 closed when the push bar 120 is the rest position. More particularly, the dispensing tube 118 also extends through an aperture 1.58 in a first housing tube plate 159, and through an aperture 160 in a second housing tube plate 161. The first housing tube plate 159 and the second housing tube plate 161 are integral with or otherwise securely associated with the housing 112. Here they are shown extending from the back plate 148 that forms a portion of the dispenser housing 112. The push bar plate 152 is positioned between the first housing tube plate 159 and the second housing tube plate 161, and all of these elements work together to pinch the tube 118. The first and second housing tube plates 159, 161 and their respective apertures 158, 160 thus serve as a second pinch member. The functioning of these first and second pinch members will be described more particularly below.

The dispensing tube 118 extends from the pump 124, as already described with respect to the dispensing tube 18 and the pump 16. The dispensing tube 118 extends through the first and second pinch members, and its distal end 134 is secured to the push bar 120 at a mount 132 substantially as already described with respect to the mount 32 in the previous embodiment. The first housing tube plate 159 lies above the push bar plate 152, while the second housing tube plate 161 lies below the push bar plate 152. Thus, for the orientation shown in the figures, the dispensing tube 118 extends first through aperture 158 in the first housing tube plate 159, then extends through the aperture 150 in the push bar plate 152, and then finally extends through the aperture 160 in the second housing tube plate 161 to then be secured at the mount 132. Because the push bar 120 and its associated push bar plate 152 move relative to the first and second housing tube plates 159, 161, which are substantially stationary plates extending from the housing 112, the dispensing tube 118 is forced to move relative to the first and second housing tube plates 159, 161 when the push bar 120 is manipulated to dispense product as already described with respect to the embodiment of FIGS. 1-4 and as seen in a comparison of FIGS. 5 and 6. In FIG. 5, the push bar 120 is in the rest position, distanced away from the back plate 148, and, thus, the dispensing tube 118 is pulled to the left by contact with the right-hand side of the apertures 150 in the push bar plate 152. However, this leftward movement of the dispensing tube 118 is impeded by the left-hand side of the apertures 158 and 160 in the housing tube plates 159, 161, such that, as seen in FIG. 5, the dispensing tube 118 is pinched closed by the interaction of the push bar plate 152 and the first and second housing tube plates 159 and 161 and the associated apertures 150, 158, and 160, i.e., the dispensing tube 118 is pinched closed by the interaction of first and second pinch members.

In this embodiment, the push bar plate 152 and its aperture 150 are sized such that, when the push bar 120 is in the rest position, the apertures 150, 158 and 160 are sufficiently out of alignment such that the vertical path through the apertures 158, 150 and 160 is sufficiently serpentine to ensure that the dispensing tube 118 fed therethrough is pinched closed. With the dispensing tube 118 pinched between these first and second pinch members, the contents within the dispensing tube 118 and above the location where the tube is pinched cannot drip out of the dispensing tube 118. With reference to FIG. 6, it can be seen that the push bar tube plate 152 and aperture 150 are also sized such that, in the actuated position, the apertures 150, 158 and 160 are sufficiently aligned such that the vertical path through apertures 158, 150 and 160 is straight enough to ensure that the dispensing tube 118 is not pinched closed, and, instead, is open to fluid flow, thus permitting product to be dispensed when the push bar 120 is moved from the rest position to the actuated position.

By providing such first and second pinch members, the dispenser can be prevented from dripping product when in the rest position. This is particularly beneficial in the present dispenser inasmuch as it is intended to suck residual product back into the dispensing tube 118 by means of the bellows shape provided to the dispensing tube. The residual product, particularly if it is a foam product, will tend to break down in the dispensing tube and, absent a closing of the dispensing tube, would tend to drip.

While plate members and apertures have been disclosed as being used for the first and second pinch members, it should be appreciated that other structures could be provided to create the necessary aforementioned vertical paths. Additionally, while the first housing tube plate 159 is shown as positioned above the push bar plate 152 and the second housing tube plate 161 is shown positioned below the push bar plate 152, a single housing tube plate can be successfully implemented if sized properly such that, in a rest position, a sufficiently narrow or serpentine dispensing tube passageway is formed through apertures provided in the single housing tube plate and the push bar plate.

In light of the foregoing, it should be clear that this invention provides improvements in the art of liquid dispensers. While a particular embodiment has been disclosed herein for the purpose of teaching the inventive concepts, it is to be appreciated that the invention is not limited to or by any particular structure shown and described. Rather, the claims shall serve to define the invention.

We claim:

1. A dispenser comprising:

a housing;

a push bar movable between a rest position and an actuated position;

a container retained in said housing and holding a liquid;

a pump associated with said liquid in said container, said pump being actuated to dispense a dose of said liquid when said push bar is moved from said rest position to said actuated position;

a dispensing tube including:

an inlet associated with said pump, an outlet, and a bellows portion between said inlet and said outlet, wherein said dispensing tube is secured to said push bar such that, upon moving said push bar from said rest position to said actuated position, said bellows is collapsed from an expanded volume to a compressed volume and said outlet moves with said push bar;

a first pinch member associated with said push bar; and a second pinch member associated with said housing, wherein a portion of said dispensing tube is pinched between said first pinch member and said second pinch member when said push bar is in said rest position such that the contents within said dispensing tube above the location where the tube is pinched cannot drip out of said dispensing tube.

2. The dispenser of claim 1, wherein said push bar is pivotally mounted to said housing.

3. The dispenser of claim 2, wherein, when said push bar is in said actuated position, said dispensing tube is not engaged by said first and second pinch members and product may therefore flow out of said dispensing tube.

4. The dispenser of claim 3, wherein said first pinch member moves with said push bar.

5. The dispenser of claim 4, wherein said second pinch member includes a housing tube plate extending from said housing.

6. The dispenser of claim 5, wherein said first pinch member includes at least one push bar plate extending from said push bar.

7. The dispenser of claim 6, wherein said housing tube plate includes an aperture and said at least one push bar plate includes an aperture, and said dispensing tube extends through both said apertures.

8. The dispenser of claim 7, wherein said aperture in said housing tube plate is substantially aligned with said aperture in said push bar plate in said actuated position, such that fluid flow through the dispensing tube is not affected, and wherein said aperture in said housing tube plate is substantially out of alignment with said aperture in said push bar plate in said rest position, such that the peripheries defining said apertures pinch said dispensing tube to resist fluid flow through said dispensing tube.

9. The dispenser of claim 8, wherein said push bar plate is pivotally secured to said push bar at one end, and at an opposite end is pivotally retained within a track member associated with said housing.

10. A dispenser comprising:

a housing;

a push bar movable between a rest position and an actuated position;

a container retained in the housing and holding a liquid;

a pump having an inlet associated with said liquid in the container and an outlet, the pump being actuated to dispense a dose of liquid when the push bar is moved from the rest position to the actuated position;

a dispensing tube including:

an inlet connected to the pump outlet;

an outlet;

a first pinch member associated with the push bar; and a second pinch member associated with the housing, wherein a portion of the dispensing tube is pinched between the first pinch member and the second pinch member when the push bar is in the rest position.

11. The dispenser of claim 10 wherein the dispensing tube comprises a bellows portion.

12. The dispenser of claim 11 wherein the bellows portion is corrugated.

13. The dispenser of claim 10 wherein an end of the dispensing tube is connected to the push bar.

14. The dispenser of claim 10 wherein the inlet of the flexible dispensing tube is configured to be closer to the back of the dispenser than the outlet of the flexible dispensing tube when the refill unit is installed in the dispenser.

15. A refill unit for a dispenser that has a pinch member comprising:

a container;

a pump having an inlet connected to the container;

the pump having an outlet;

a flexible dispensing tube connected to the pump outlet;

the flexible dispensing tube having an open passageway therethrough; and the flexible dispensing tube having a collapsible portion configured to be positioned between a first pinch member and a second pinch member when the refill unit is installed in a dispenser;

wherein the first pinch member and the second pinch member are configured to pinch the collapsible portion of the flexible dispensing tube to prevent fluid from passing through the collapsible portion of the flexible dispensing tube.

16. The refill unit of claim 15 wherein the flexible dispensing tube comprises a bellows portion.

17. The refill unit of claim 16 wherein the bellows portion is corrugated.

18. The refill unit of claim 15 wherein an end of the dispensing tube is configured to connect to a push bar.

19. The refill unit of claim 15 wherein the inlet of the flexible dispensing tube is configured to be closer to the back of the dispenser than the outlet of the flexible dispensing tube when the refill unit is installed in the dispenser.

20. The refill unit of claim 15 wherein the dispensing tube comprises channels to retain liquid and prevent at least a portion of the liquid from dripping.

* * * * *